US007434785B1

(12) United States Patent
McMorrow

(10) Patent No.: US 7,434,785 B1
(45) Date of Patent: Oct. 14, 2008

(54) SHOT TOOL ENTRY SYSTEM

(76) Inventor: John F. McMorrow, 162 Beach 119th St., Rockaway Park, NY (US) 11694

( * ) Notice: Subject to any disclaimer, the term of this patent is extended or adjusted under 35 U.S.C. 154(b) by 42 days.

(21) Appl. No.: 11/385,437

(22) Filed: Mar. 21, 2006

Related U.S. Application Data

(60) Provisional application No. 60/721,459, filed on Sep. 28, 2005.

(51) Int. Cl.
*B66C 21/00* (2006.01)

(52) U.S. Cl. ..... 254/291; 254/134

(58) Field of Classification Search ..... 254/291, 254/93 R, 133 R, 93 H, 134
See application file for complete search history.

(56) References Cited

U.S. PATENT DOCUMENTS 4,657,225 A 4/1987 Hoehn et al.
5,044,033 A 9/1991 Fosberg
5,088,174 A 2/1992 Hull et al.
5,177,850 A * 1/1993 Hull et al. ..... 29/254
5,196,647 A * 3/1993 Majors ..... 102/303
5,398,773 A * 3/1995 Baker ..... 173/90
5,415,241 A 5/1995 Ruffu et al.
5,810,333 A * 9/1998 Hickerson et al. ..... 254/93 R
5,842,623 A * 12/1998 Dippold ..... 227/10
5,987,723 A * 11/1999 McNally et al. ..... 29/254
6,035,946 A 3/2000 Studley et al.
6,318,228 B1 * 11/2001 Thompson ..... 89/1.14
6,394,405 B1 * 5/2002 Roxton et al. ..... 248/354.1
6,631,668 B1 * 10/2003 Wilson et al. ..... 89/1.14
6,889,591 B2 5/2005 Sabates et al.

OTHER PUBLICATIONS

Website: Hydra-Ram by Fire Hooks Unlimited; visited Aug. 11, 2005; 2 pages (copy enclosed).

* cited by examiner

*Primary Examiner*—Lee D Wilson
(74) *Attorney, Agent, or Firm*—Collard & Roe, P.C.

(57) ABSTRACT

A forcible entry tool for gaining access to a secured structure includes a a hollow elongated housing defining an interior chamber therein. The hollow elongated housing has an operative end adapted to manually seat the forcible entry tool. A force arm is disposed substantially within the interior chamber and includes an impact head adapted to impact the secured structure. A force arm drive displaces the force arm at a high velocity to impact the secured structure.

19 Claims, 16 Drawing Sheets

SHOT TOOL ENTRY SYSTEM

CROSS REFERENCE TO RELATED APPLICATIONS

This application claims the benefit of U.S. Provisional Application No. 60/721,459 filed on Sep. 28, 2005.

BACKGROUND OF THE INVENTION

1. Field of the Invention

The invention relates to forcible entry tools for gaining access to secured structures. In particular, the invention relates to forcible entry tools having force arms that are displaceable at high velocities for impacting a secured structure.

2. The Prior Art

Various tools and devices for gaining access to secured structures, such as locked doors, are known. Known forcible entry tools include manual tools, for example haligan-type tools having an elongated bar with a pointed piercing member, known as a pike, and a prying surface, known as an adz, disposed at one end and a forked surface disposed at an opposite end.

In addition to manual tools, various devices employing hydraulic or pneumatic forces to gain access to secured structures are known, particularly in the firefighting field. Such devices open the secured structure, for example a locked door, in a slow, controlled manner. This slow, controlled opening technique is appropriate for firefighting applications, wherein dynamic opening may result in the rapid introduction of oxygen into an unstable environment and wherein it may be necessary to quickly close the entry door if the gasses entering the open door begin to ignite.

Although desirable in firefighting applications, the slow, controlled opening achieved by hydraulic and pneumatic forcible entry tools is unsuitable for law enforcement, military and other applications wherein set up and exposure time must be limited. In such applications, dynamic, fast opening is desired to speed the attack on perpetrators or the enemy, as well as to confuse and disorient them. Personnel using a forcible entry tool in such situations must limit the time during which they are in an area proximate the secured structure and accordingly exposed to potential attack from persons on the other side of the structure. For example, in the time it may take to pump a hydraulic forcible entry tool or to set up a pneumatic forcible entry tool, an entry team could be attacked by shotgun fire or other weaponry by persons situated on the other side of the entryway.

The following references, the disclosure of which is hereby incorporated by reference, relate to forcible entry tools and/or devices: U.S. Pat. Nos. 5,987,723 to McNalley et al.; 5,044,033 to Fosberg; 6,889,591 to Sabates et al.; 6,631,668 to Wilson et al.; 5,088,174 to Hull et al.; 5,415,241 to Ruffu et al.; 4,657,225 to Hoehn et al.; 6,035,946 to Studley et al. and 6,318,228 to Thompson.

Although a number of the above-listed references show forcible entry tools wherein a force arm is driven with a blank munition charge to achieve a high impact velocity, none of the known forcible entry tools achieve the advantages of a forcible entry tool according to an embodiment of the invention. In particular, known forcible entry tools do not adequately address the problem of recoil of the tool following ejection of the force arm. Moreover, the known forcible entry tools do not provide an effective and versatile system for positioning or seating the tool in order to apply force where needed to achieve the goal of gaining access to the secured structure.

Accordingly, there exists a need for a forcible entry tool which overcomes these and other shortcomings of the heretofore known forcible entry tools and devices.

SUMMARY OF THE INVENTION

The invention relates to forcible entry tools for gaining access to secured structures. In particular, the invention relates to forcible entry tools having force arms that are displaceable at high velocities for impacting a secured structure.

A forcible entry tool according to an embodiment of the invention includes a hollow elongated housing. The hollow elongated housing defines an interior chamber within the housing. The hollow elongated housing includes an operative end adapted to manually seat the forcible entry tool. A force arm is disposed substantially within the interior chamber. The force arm has an impact head adapted to impact the secured structure. A force arm drive displaces the force arm at a high velocity to impact the secured structure.

An advantage of a forcible entry tool according to an embodiment of the invention is that a hollow elongated housing defines an interior chamber in which a displaceable force arm is disposed. The force arm can be displaced from the housing at a high velocity to impact and gain access to a secured structure. The housing further includes an operative end adapted to manually seat the forcible entry tool. As a result, a forcible entry tool according to an embodiment of the invention retains its capabilities as a manual tool. In many applications, a user may be able to gain access to a secured structure using only the manual features of the tool, for example a prying or piercing member, without the need for discharging the force arm.

A further advantage of a forcible entry tool according to an embodiment of the invention is that an operative end of the tool housing is adapted to manually seat the tool. This feature allows the tool to be manipulated into a myriad of different positions for exerting force on the secured structure precisely where needed. The manual seating of the operative end of the housing allows the forcible entry tool to be positioned as required for the force arm to be discharged to utilize the explosive force of the tool as well as the leverage provided by the operative end of the housing.

Another advantage of a forcible entry tool according to an embodiment of the invention is that the design of the tool makes maximum use of the kinetic energy produced. For example, when used to open an inward opening secured door, the operative end of the housing may function to rip the door jamb backwards as the force arm punches the door forward. The reverse would occur in the case of an outward opening door. In this way, a forcible entry tool according to an embodiment of the invention employs both active and reactive forces.

A further advantage of a forcible entry tool according to an embodiment of the invention is that the tool addresses the problem of recoil inherent in high impact velocity forcible entry tools and makes use of both forward and backward recoil. Known forcible entry tools have only made use of the forward action of the tool and have attempted to mitigate or suppress the backward action or recoil. The design of a forcible entry tool according to an embodiment of the invention makes efficient use of both forward and backward acting forces so as to put the sum total of active force produced at the impacting end of the tool exactly where the force is needed.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
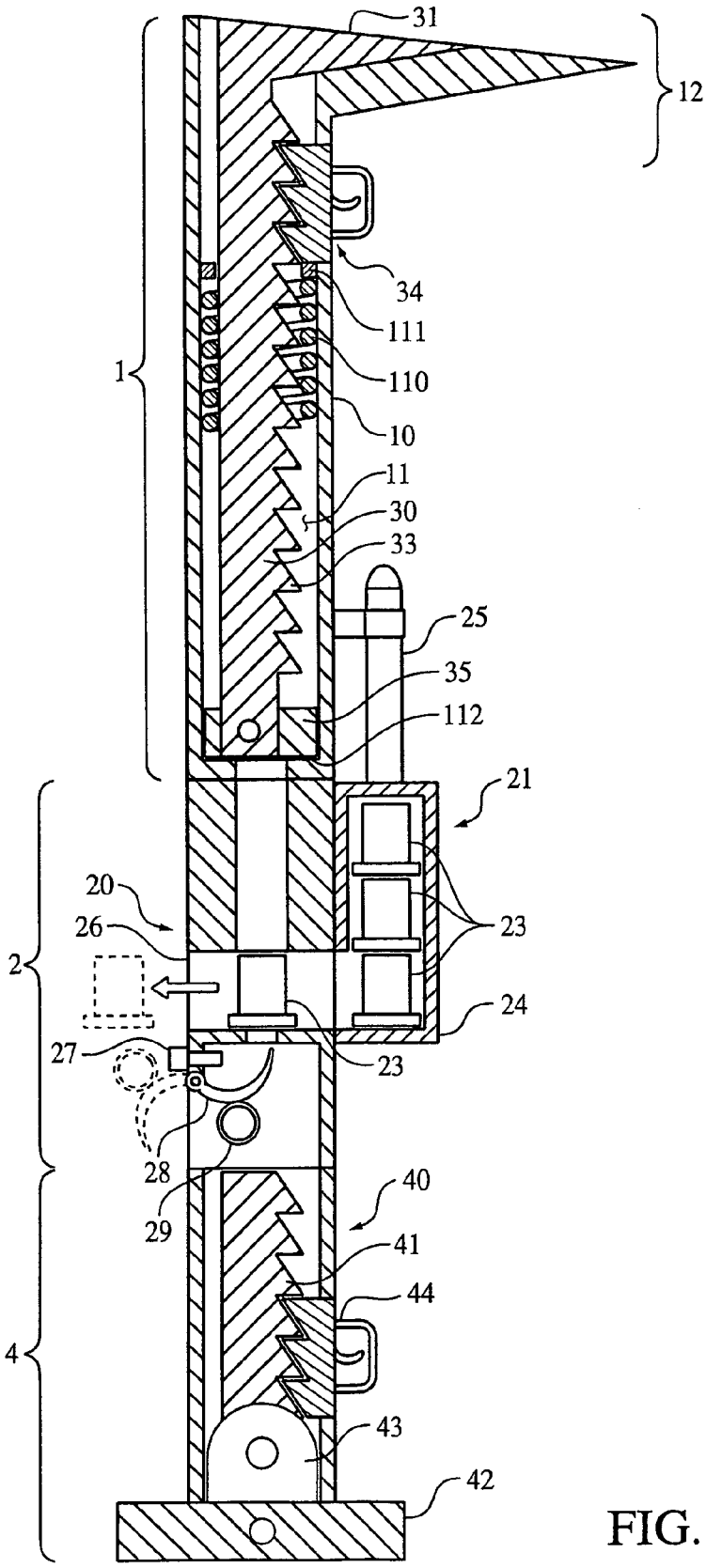
FIG. 1 shows a cutaway side view of a forcible entry tool according to an embodiment of the invention.

Referring now in detail to the drawings and, in particular, FIG. 1 shows a cutaway side view of a forcible entry tool according to an embodiment of the invention. As shown, the forcible entry tool includes a hollow elongated housing 10. Elongated housing 10 may comprise a rigid, tubular structure defining an interior chamber 11 therein. Interior chamber 11 is sized and shaped to receive a force arm or hammer arm 30 disposed within the interior chamber 11.

Elongated housing 10 has an operative end 12 disposed at one end of the housing. Operative end 12 is adapted to manually seat the forcible entry tool in order to position the tool for gaining access to a secured structure, for example a locked door. In this way, operative end 12 of housing 10 may function as a manual forcible entry tool and accordingly may be configured with a variety of designs depending on the particular application. Operative end 12 may be formed integrally with housing 10 or as a separate component or components and secured thereto.

Figure 3:
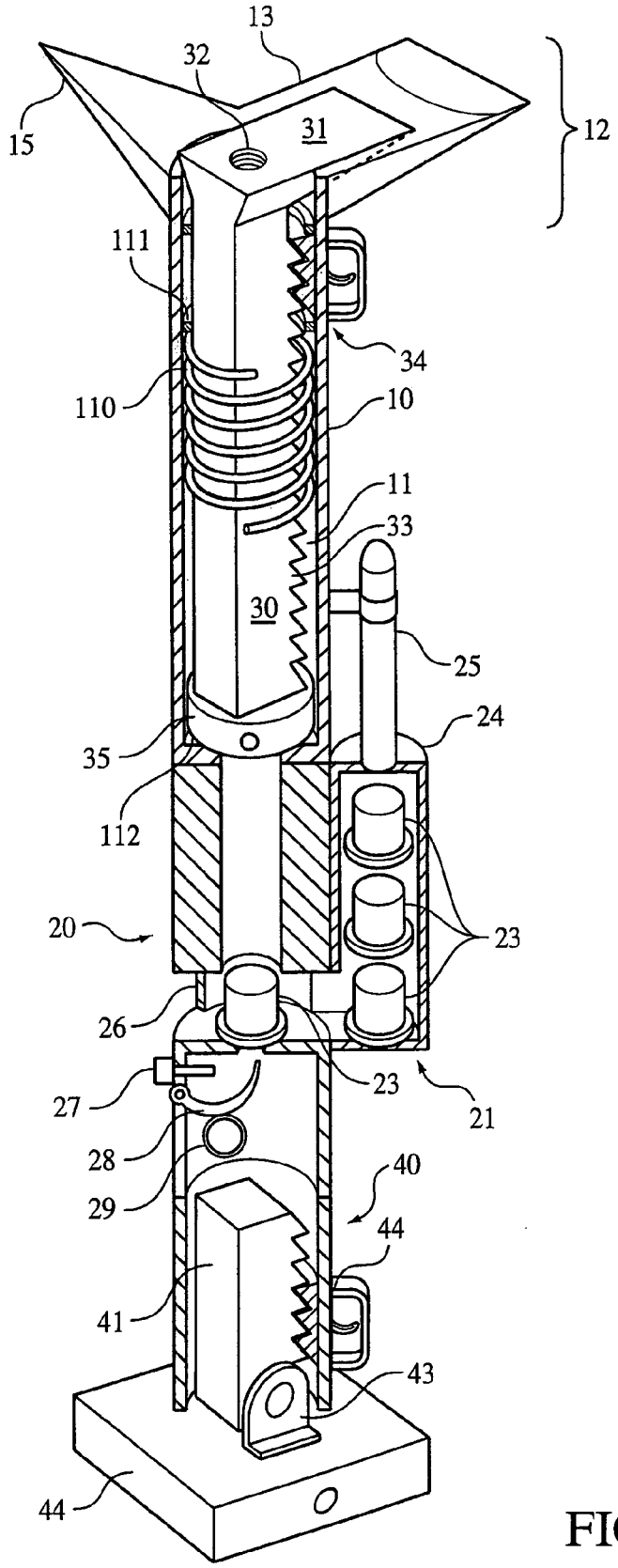
FIG. 3 shows a perspective view of the forcible entry tool shown in FIG. 1.
Figure 4:
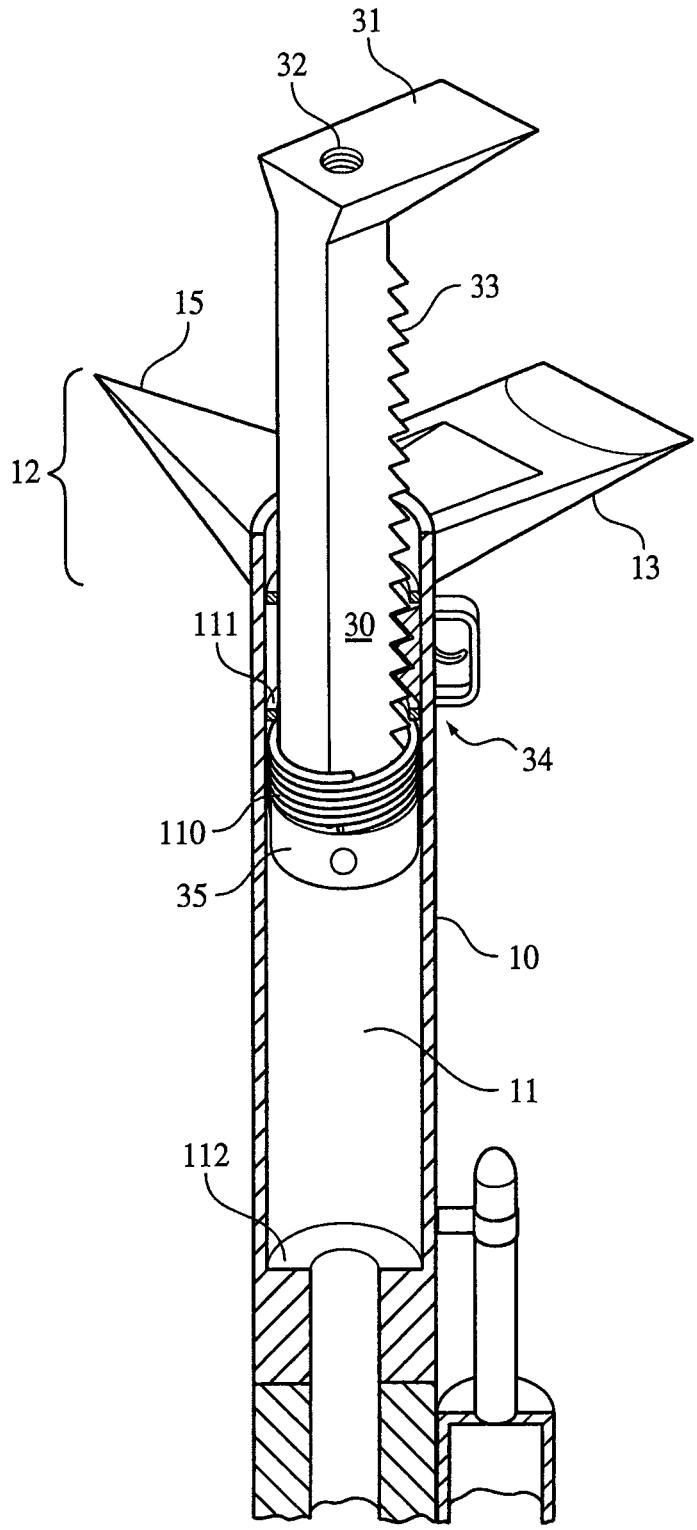
FIG. 4 shows a perspective view of an operative end of a forcible entry tool according to an embodiment of the invention with a force arm extended in a discharged position.
Figure 5:
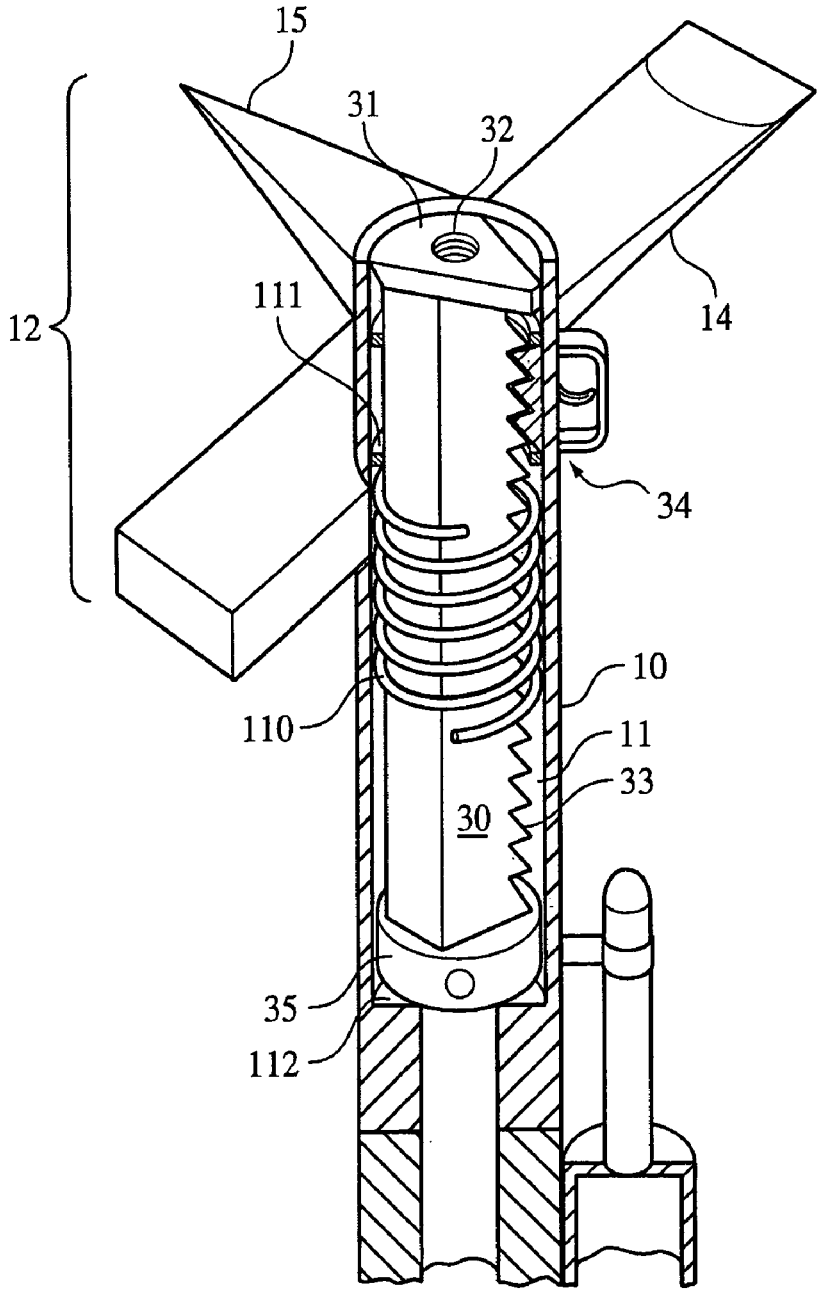
FIG. 5 shows a perspective view of an operative end of a forcible entry tool according to an embodiment of the invention having an angled prying surface.

For example, operative end 12 of housing 10 may comprise a prying member 13. In use, prying member 13 may be wedged between two surfaces of the secured structure, for example between a door and a door frame or jamb surface. As shown in FIGS. 3 and 4, prying member 13 may comprise a wedge-shaped member projecting from an end of housing 10. Prying member 13 may be arranged substantially perpendicular to the length of housing 10 and may have substantially flat top surface and a relatively wide pointed end. Prying member 13 may resemble an adz portion of a manual forcible entry tool and function in a similar manner. As shown in FIG. 5, prying member 13 may also be arranged as an angled prying member 14, which is disposed at an angle with respect to hollow elongated housing 10. Angled prying member 14 is configured to provide a different angle of attack and may be particularly useful for gaining access to structures comprising outward opening doors.

Figure 6:
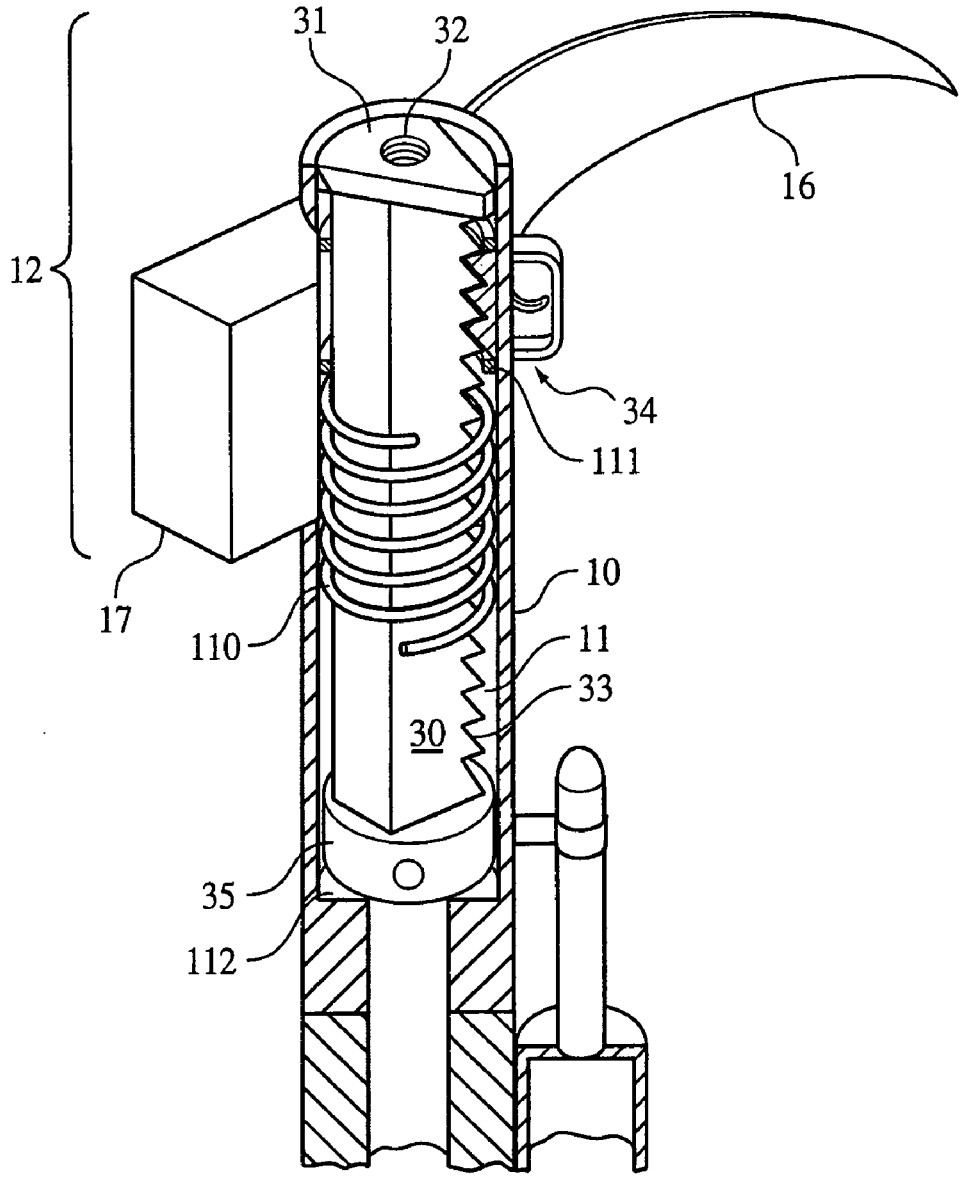
FIG. 6 shows a perspective view of an operative end of a forcible entry tool according to an embodiment of the invention having an elongated, curved piercing member and a tapping block.

Operative end 12 of housing 10 may further comprise a piercing member 15. In use, piercing member 15 may be used to pierce or penetrate a portion of the secured structure, for example a wood door, door frame or door jamb. As shown in FIGS. 3, 4, and 5, piercing member 15 may comprise a sharp, pointed member projecting from an end of housing 10. Piercing member 15 may be arranged substantially perpendicular to the length of housing 10. Piercing member 15 resemble a pike portion of a manual forcible entry tool and function in a similar manner. As shown in FIG. 6, piercing member may also comprise an elongated curved member 16 projecting from housing 10. Elongated curved member 16 is configured to provide different angles of attack and may be worked below a secured door or used to rip a secured door from its hinges.

As shown in FIG. 6, a tapping block 17 may be disposed at operative end 12 of housing 10. Tapping block 17 may comprise, for example, a block-shaped member projecting outwardly from the housing opposite a prying member or piercing member. Tapping block 17 includes a substantially flat contact surface and is used to assist in driving an operative end 12 of a forcible entry tool according to an embodiment of the invention into a desired position for gaining access to the secured structure. For example, tapping block 17 may be struck with a sledge hammer or other tool in order to drive a prying member 13 or piercing member 15 into a secured structure in order to seat the forcible entry tool into position to gain access to the secured structure. In an advantageous embodiment, a sledge hammer tool attachment 50 (shown in FIGS. 8, 11 and 17 and described more fully herein) may be used in conjunction with tapping block 17 to seat operative end 12 of housing 10.

Force arm 30 comprises a rigid member disposed substantially within interior chamber 11 of housing 10. Force arm 30 is adapted to be ejected from the forcible entry tool at a high velocity to impact a secured structure in order to gain access thereto. An impact head 31 adapted to impact the secured structure is disposed at an end of force arm 30 as shown. Impact head 31 may comprise a variety of shapes as appropriate to a particular application. For example, impact head 31 may have a substantially rectangular shape with a substantially flat contact surface, as depicted in FIGS. 3 and 4. Alternatively, impact head 31 may be substantially triangular or pie-shaped with a substantially flat contact surface, as depicted in FIGS. 5 and 6. In addition, the impact head 31 may comprise a substantially square, rounded or any other appropriate shape.

Figure 9:
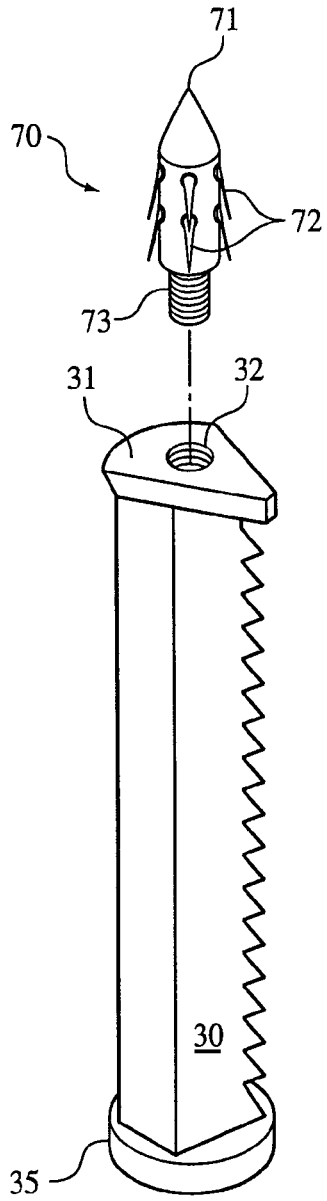
FIG. 9 shows a pointed tip attachment for a forcible entry tool according to an embodiment of the invention.
Figure 10:
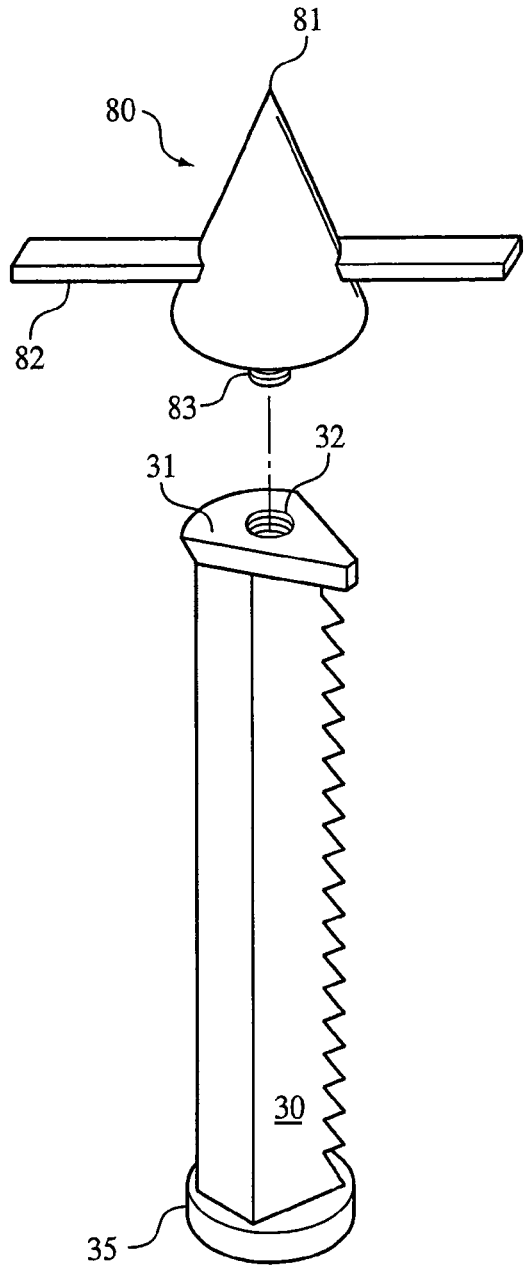
FIG. 10 shows a cone-shaped door plate attachment for a forcible entry tool according to an embodiment of the invention.

Impact head 31 may comprise a connection or receiving port 32 for detachably securing various attachments to force arm 30. As shown, connection port 32 may comprise an opening adapted to receive a corresponding projection disposed on a force arm attachment member, for example a pointed barbed tip 70 as shown in FIG. 9 or a cone door plate 80 as shown in FIG. 10, each of which is described in more detail herein. Connection port 32 may further include a threaded opening corresponding to a mating threaded projection on an attachment member for detachably securing the attachment member to impact head 31.

Force arm 30 may include a serrated or toothed portion 33 and a lockout release mechanism 34 for maintaining the force arm in its forward, ejected position after being driven forward at a high velocity by a force arm drive. Lockout release mechanism 34 may include a serrated or toothed member which is adapted to engage the serrated portion 33 of force arm 30. This member may be spring biased inwardly toward the serrated portion 33 of the force arm 30. As shown, the teeth or serrations 33 on the force arm 30 and on the lockout release mechanism 34 may be arranged so that the serrated member of the lockout release mechanism 34 are pushed down and away from the force arm 30 when the force are is displaced toward a secured structure. The serrated lockout release member than returns to its inwardly biased position to engage the serrated portion 33 of the force arm 30 to lock out the force arm in an extended position in the manner of a manual jack as shown in FIG. 4.

In some situations, one shot with the force arm 30 may not be enough to gain access to the secured structure and a second, third or subsequent impacts will be required. Accordingly, the force arm 30 can be released from its locked out extended position using a lockout release trigger to displace the serrated member of lockout release mechanism 34. Once the extended force arm has been released, it may be fired again from a partially extended position or, alternatively, the force arm 30 may be re-seated in the interior chamber 11 of the housing 10 for additional firing. The initial spread between the door and jamb may be used to deliver grenades, tear gas, concussion devices and the like while the forcible entry tool is prepared for a second or subsequent shot.

As shown, a spring member 110 may be optionally disposed within interior chamber 11 of housing 10 to absorb some of the energy and momentum of force arm 30 as it is displaced from housing 10. A rear portion of force arm 30 may include a ball spring stop 35 for allowing the force arm 30 to be released from the housing in the event the force arm is fired from the housing 10 and is not met with a sufficient degree of resistance. The ball spring stop 35 allows the force arm 30 to separate from and fly out of the housing 30 if the force arm is ejected and encounters a low level of resistance, so that the momentum of the force arm 30 is not transferred to the operator of the forcible entry tool, causing the operator to be pulled forward and possibly injured.

As shown, ball spring stop 35 may comprise an enlarged flange member detachably secured to an end portion of force arm 30. For example, an end of force arm 30 may include am outwardly biased ball spring or a shear pin which extends through an appropriately sized opening in the enlarged flange member to detachably secure the flange to the end of the force arm 30. In most situations force arm 30, once fired, will be met with a degree of resistant force from the secured structure which is sufficient to stop the travel of force arm 30 and prevent the force arm 30 from being completely ejected from the housing 10. Lockout release mechanism 34 then functions to lock the force arm 30 in its extended position.

In some instances, however, force arm 30 may not be met with sufficient force from the secured structure, for example if the structure has not been sized up properly and gives way very easily to the impact of force arm 30. In such instances, as the force arm 30 is ejected at high velocity, the enlarged flange member detachably secured to the end of the force arm contacts one or more forward stops 111 or compresses spring member 110 into forward stops 111. The ball spring member or shear pin securing the flange to the force arm releases, allowing the force arm 30 to fly out of the housing 10, leaving the enlarged flange member behind. In this way, the operator of the forcible entry tool is not subjected to the momentum of the force arm 30 rapidly decelerating if it were prevented from being released. The ball spring stop 35 may be calibrated such that the force arm is released upon firing only when a predetermined level of resistance is not encountered. A back stop member 112 may be provided at a rear portion of the interior chamber 11. Force arm 30 is inserted into interior chamber 11 such that ball spring stop 35 is seated against back stop member 112.

A force arm drive 20 provides the energy for displacing the force arm 30 out of the housing 10 at a high velocity to impact the secured structure. Once the operative end 12 of the tool is seated, the force arm drive 20 is actuated to provide the necessary explosive force to drive the force arm 30 which will blow the entry open.

Figure 2:
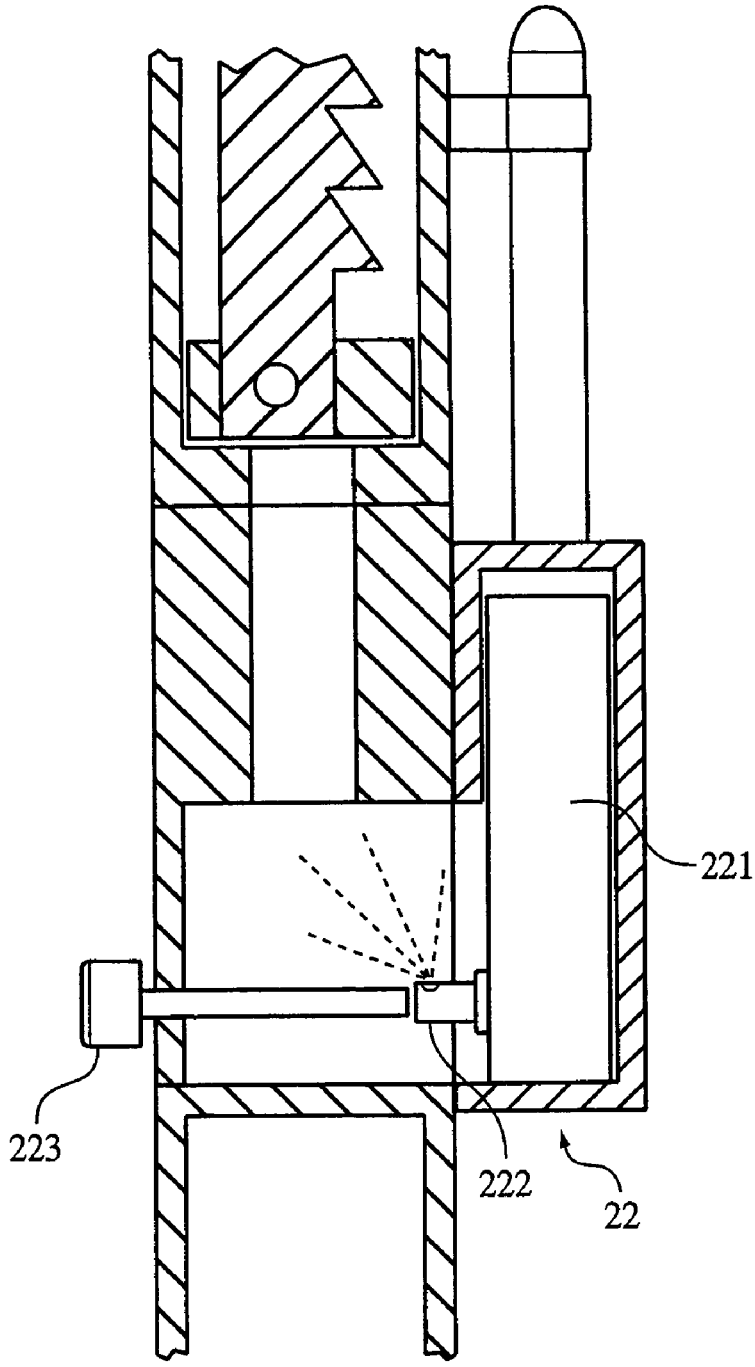
FIG. 2 shows a detailed cutaway side view of a fuel cell charge force arm drive for a forcible entry tool according to an embodiment of the invention.

Force arm drive 20 may comprise, for example, a blank munitions charge 21, as shown in FIG. 1, or alternatively a fuel cell charge 22, as shown in FIG. 2. The blank munitions charge 21 may include one or more shells or cartridges 23, for example a modified or blank shotgun shell which does not contain the conventional pellets at the end of the shell. Blank munitions charge 21 may be configured such that one shell 23 may be disposed in a chamber for firing and additional shells may be disposed in a housing 24. A pump action slide mechanism 25 may be provide which is similar in operation to a pump action shotgun, wherein a spent shell or cartridge is ejected from the chamber through an ejection port 26, as shown in FIG. 1 and a live shell or cartridge is loaded from housing 24 into the chamber.

A firing pin for striking the shell 23 may be driven by a reverse trigger configuration having a push button trigger release 27, a hinge-mounted trigger 28, and a ring 29 secured to the trigger 28. Trigger 28 may be cocked by grasping the ring 29 and rotating the trigger 28 in a clockwise direction. Push button trigger release 27, which may be electrical or mechanical, releases the trigger and fires the shell 23, thereby ejecting the force arm 30 from the housing 10 at a high velocity. As shown, prior to being cocked or after firing, trigger 28 is entirely or substantially enclosed within a housing and not exposed. This feature prevents or reduces the occurrence of misfiring while handling the forcible entry tool. Since the trigger mechanism does not project out until the trigger is cocked, which should occur after the operative end 12 of the tool has been positioned, the trigger is not susceptible to being inadvertently or prematurely fired during handling or positioning of the forcible entry tool.

FIG. 2 shows an alternative embodiment of a force arm drive 20, comprising a fuel cell charge 22. As shown, fuel cell charge 22 may comprise a cannister or container 221 holding a quantity of ignitable fluid. Cannister 221 may be disposed in a housing as shown. The cannister 221 includes a nozzle portion 222 adapted to deliver or spray a quantity of the ignitable fluid from the cannister 221 into the chamber. A push button actuator and/or ignitor 223 may initiate the delivery of the fluid into the chamber and/or ignite the fluid to produce an explosive force for ejecting force arm 30 from housing 10 toward the secured structure at a high rate of speed.

A forcible entry tool according to an embodiment of the invention may further include a jacking base 40 disposed at an end of the forcible entry tool opposite operative end 12. Jacking base 40 may operate in the manner of a manual automobile jack. As shown in FIGS. 1 and 3, jacking base 40 may comprise a serrated or toothed jacking member or arm 41 which is displaceable with respect to an end of the tool. A base 42 is attached to the jacking member 41 and may include a hinge 43 so that base 42 may pivot about the hinge 43 when the jacking base is extended. Base 41 may comprise a plate-like member having a substantially flat under surface. As shown, jacking member 41 may be completely retracted into the tool such that hinge 43 is enclosed by the tool and base 42 cannot pivot. Preferably, jacking member 40 is retracted into the tool when the forcible entry tool is being carried or as operative end 12 is being positioned to gain access to a secured structure. In this way, base 42 is prevented from moving or pivoting as the forcible entry is transported or positioned.

In operation, operative end 12 of housing 10 is positioned against a secured structure with jacking base 40 in a retracted position. Jacking base 40 is then extended as required and locked into place. A locking and releasing mechanism 44 may be provided for locking and releasing the jacking member 41. The base 42 can then be pivoted about hinge 43 into place and positioned against a floor, wall or other structure surface to brace the tool against recoil. Base 42 may include a skid or slip resistant surface, for example a rubber surround to prevent base 42 from slipping. The skid resistant base surface may prevent slipping when the base 42 is positioned on a floor surface.

Figure 7:
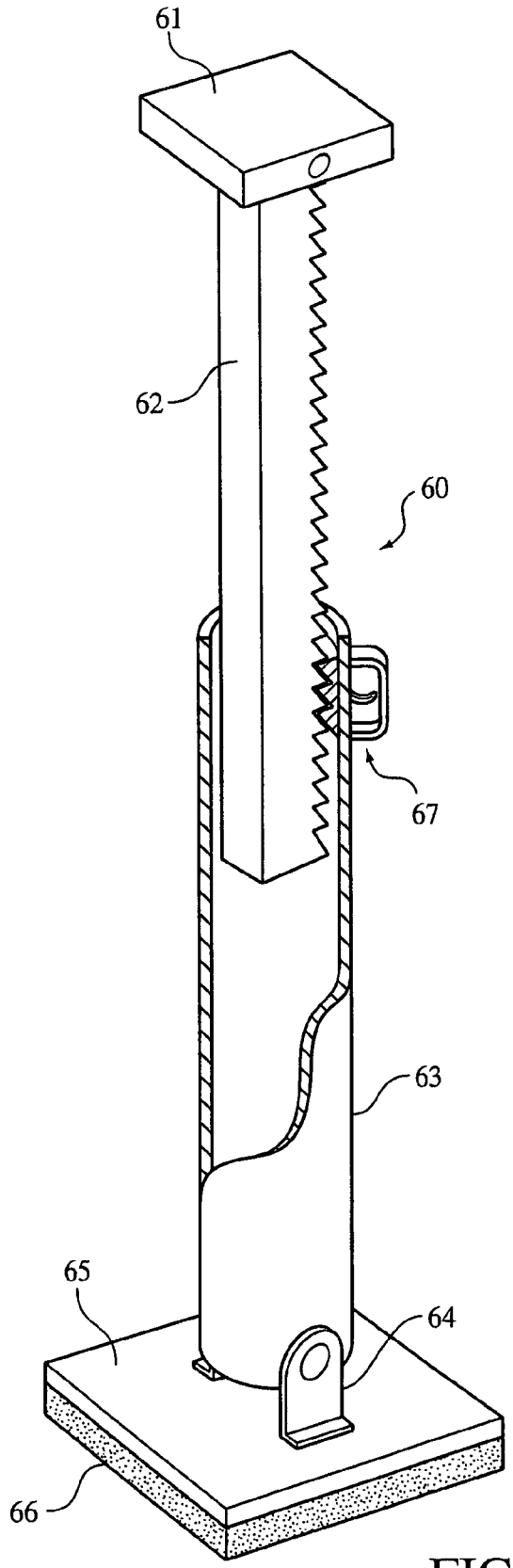
FIG. 7 shows a perspective view of a base plate attachment for a forcible entry tool according to an embodiment of the invention.
Figure 8:
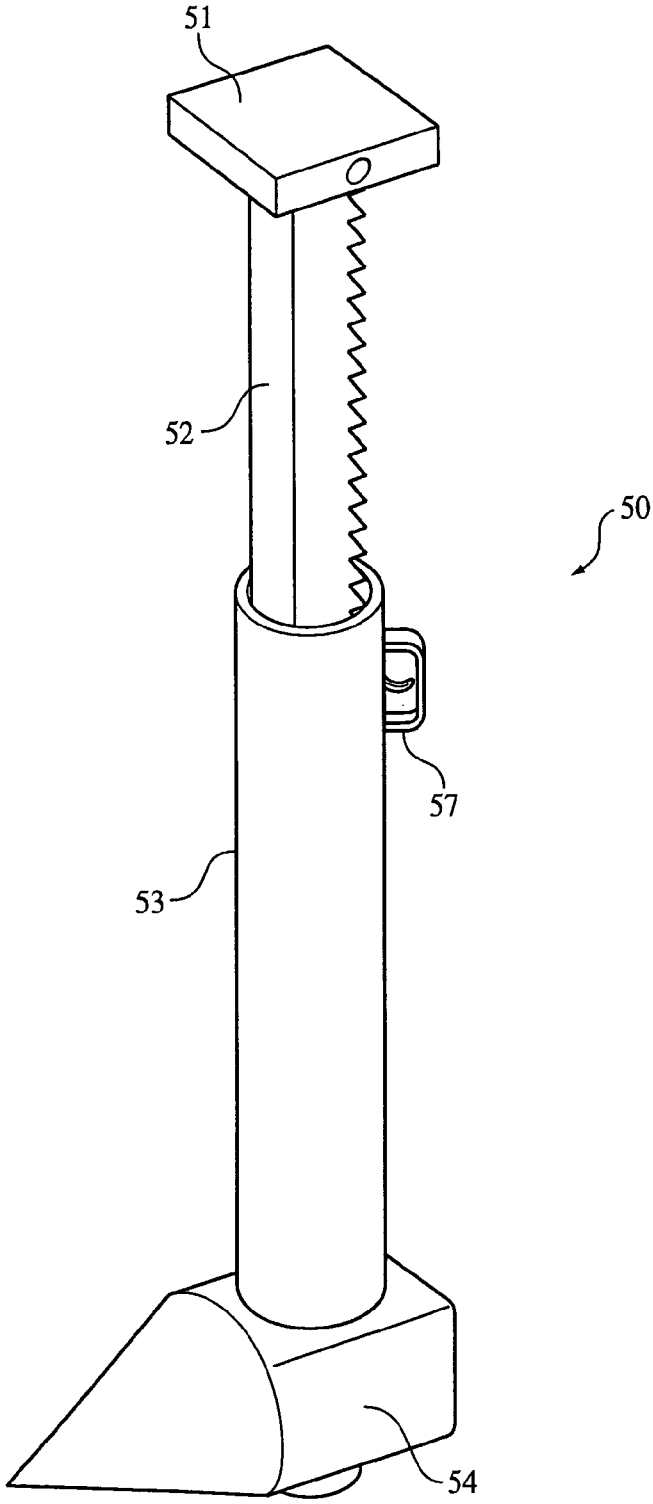
FIG. 8 shows a perspective view of a sledge hammer attachment for a forcible entry tool according to an embodiment of the invention.
Figure 11:
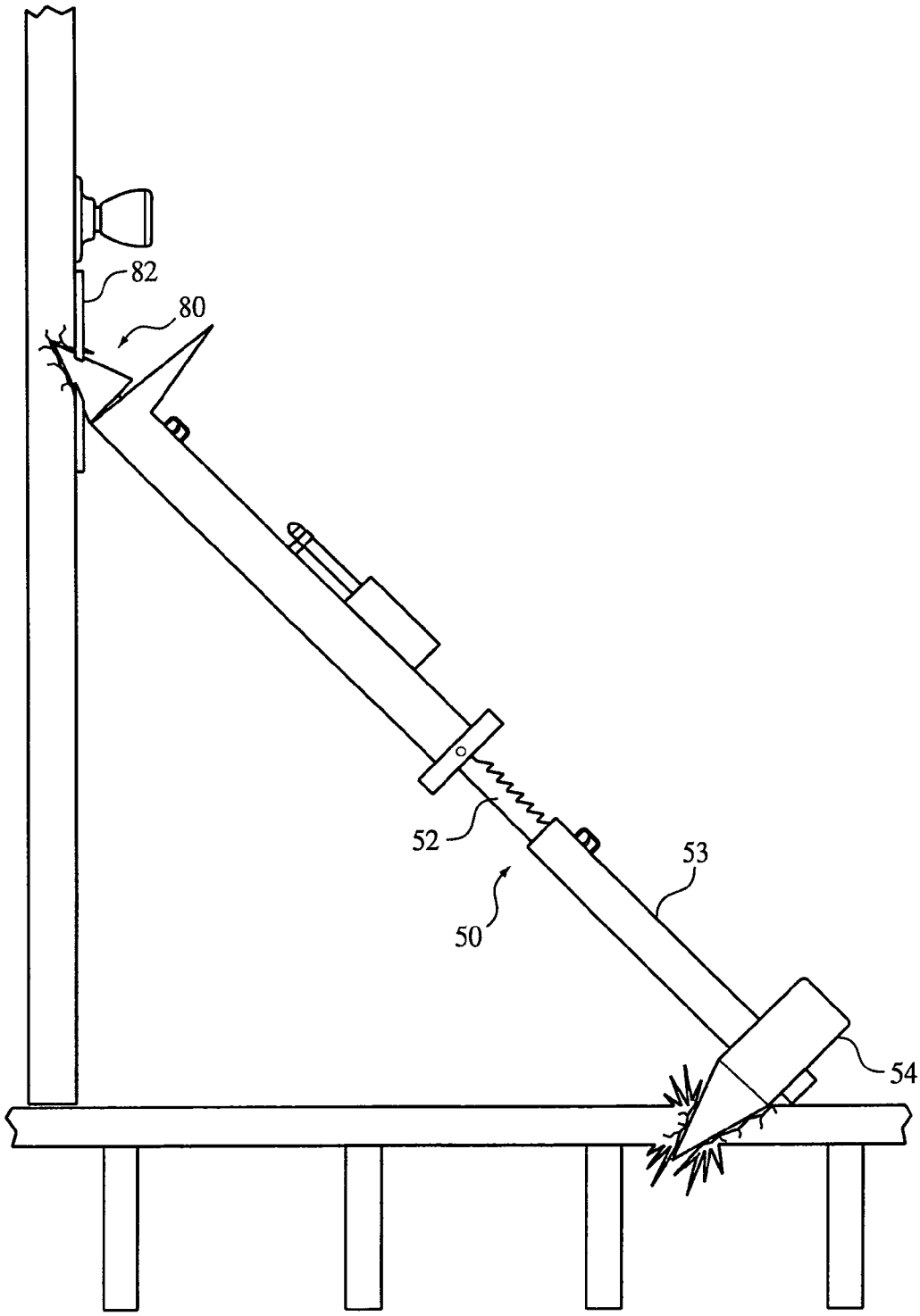
FIG. 11 shows a forcible entry tool according to an embodiment of the invention in an operating position with a sledge hammer attachment secured thereto.
Figure 12:
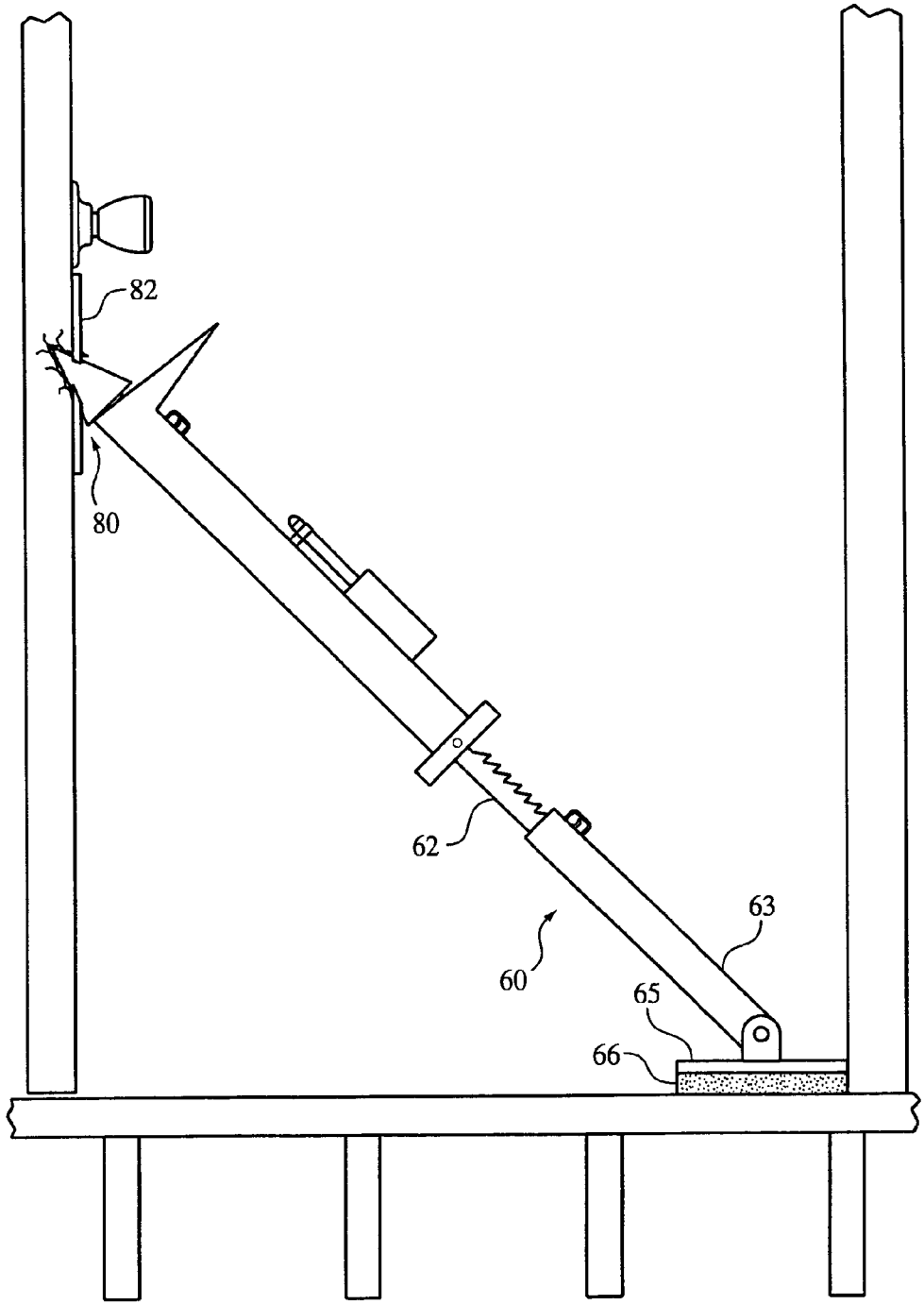
FIG. 12 shows a forcible entry tool according to an embodiment of the invention in an operating position with a base plate attachment secured thereto.
Figure 13:
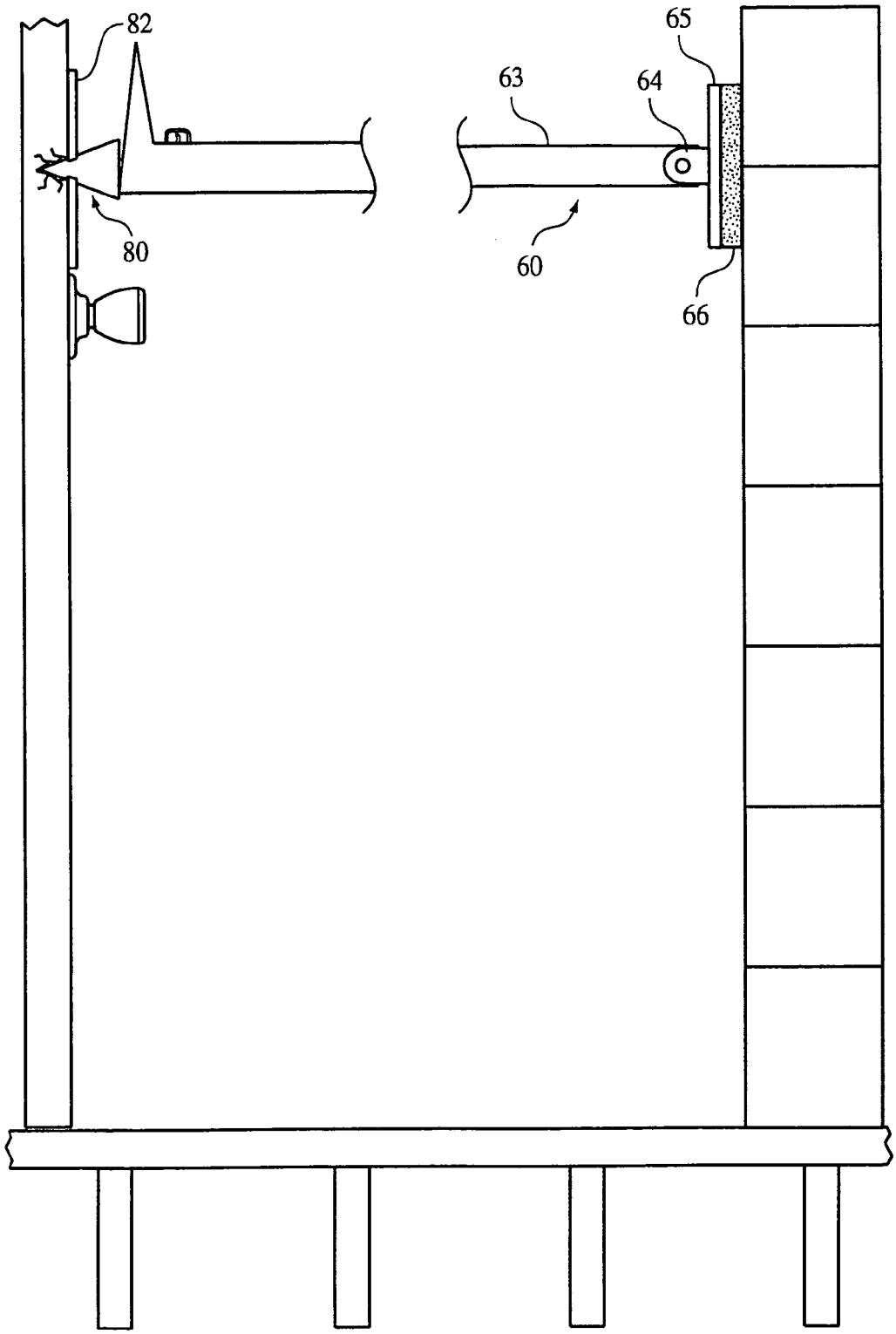
FIG. 13 shows a forcible entry tool according to an embodiment of the invention in a second operating position with a base plate attachment secured thereto.

Base 42 of jacking base 40 may further be adapted to receive various attachments, for example a sledge hammer tool attachment 50, as shown in FIGS. 8 and 11 or an additional base plate attachment 60, as shown in FIGS. 7, 12 and 13 and described in detail herein. For example, base 42 may comprise a hollowed out portion sized and shaped to receive a corresponding member of an attachment tool. The attachment tool is preferably detachably secured to the forcible entry tool. For example, an attachment may be secured with a ball spring mechanism, removable pin, or any appropriate mechanical fastening means.

A forcible entry tool according to an embodiment of the invention may have various dimensions depending on its particular application. For example, a forcible entry tool according to an embodiment of the invention may have a length of approximately twenty-four to sixty inches, preferably approximately forty-two to fifty-five inches. A force arm according to an embodiment of the invention may have a length such that the force arm is capable of adequately spreading a door or other secured structure. For example, a force arm according to an embodiment of the invention may have a length of approximately fifteen to twenty inches.

A forcible entry tool according to an embodiment of the invention may be constructed from metal, plastic and/or composite materials. The materials of construction selected should be appropriate to withstand the rugged duties of the forcible entry tool. Additionally, a forcible entry tool according to an embodiment of the invention may comprise a plurality of discrete components or groups which can be readily assembled, disassembled and interchanged. For example, as shown in FIG. 1, a forcible entry tool according to an embodiment of the invention may include a housing group 1, a firing group 2 and a jacking group 4. Each of the groups may be secured to an adjoining group in a detachable manner by way of connection ports disposed at an end of the component or group. This feature gives a forcible entry tool according to an embodiment of the invention a great deal of flexibility. For example, various housing groups 1 with various configurations of operative ends may be readily interchanged with a single firing group 2 depending on the nature of the secured structure to be breached. This interchange of housing groups may be accomplished quickly and easily on site.

FIG. 7 shows a base plate attachment 60 for a forcible entry tool according to an embodiment of the invention. Base plate attachment 60 operates in a similar manner as jacking base 40 previously described. Base plate attachment 60 may be used along with or in the place of jacking base 40 in order to brace the forcible entry tool and handle recoil. Base plate attachment 60 may provide for greater extension than jacking base 40. For example, as shown in FIG. 12 base plate attachment 60 may be used to span across a hallway and brace the tool against the wall at floor level where the floor meets the wall. As shown in FIG. 13, base plate attachment 60 may also be used to span across a hallway to brace the tool against a wall surface opposite the secured door to be breached.

As shown in FIG. 7, base plate attachment 60 may comprise a connection member 61 for securing the base plate attachment to a corresponding member on the end of the forcible entry tool. Connection member 61 may comprise, for example a flat, plate-like member sized and shaped to engage the base 42 of jacking base 40. Base plate attachment 60 may be detachably secured to the forcible entry tool, for example, with a ball spring mechanism, removable pin, or any appropriate mechanical fastening means.

Base plate attachment 60 may further comprise a serrated or toothed jacking member 62 disposed in a base plate attachment housing 63. Jacking member 62 may operate in the same manner as jacking base 40 and may be locked into position or released using locking and releasing mechanism 67. Housing 63 may be connected to a base 65 with one or more hinges 64 such that base 65 may pivot into position. Base 65 may comprise a plate-like member having a substantially flat under surface. Base 65 may include a skid or slip resistant surface 66, for example a rubber surround, to prevent base 65 from slipping. The skid resistant base surface may prevent slipping when the base 65 is positioned on a floor surface.

FIG. 8 shows a sledge hammer tool or leverage sledge hammer attachment 50 for a forcible entry tool according to an embodiment of the invention. As shown, sledge hammer tool attachment 50 may comprise a connection member 51 for securing the sledge hammer tool attachment 50 to a corresponding member on the end of the forcible entry tool. Connection member 51 may comprise, for example a flat, plate-like member sized and shaped to engage the base 42 of jacking base 40. Sledge hammer tool attachment 50 may be detachably secured to the forcible entry tool, for example, with a ball spring mechanism, removable pin, or any appropriate mechanical fastening means.

Sledge hammer tool attachment 50 may further comprise a serrated or toothed jacking member 52 disposed in a housing 53. Jacking member 52 may operate in the same manner as jacking base 40 and may be locked into position or released using locking and releasing mechanism 57. A sledge hammer head 54 is disposed at an end of housing 53 as shown. Sledge hammer head may comprise a pointed substantially conical end for penetrating and a substantially flat end for hammering and driving.

Sledge hammer tool attachment 50 may have numerous uses. Sledge hammer tool attachment 50 can be used to seat the operative end 12 of housing 10 (for example prying member or adz 13 or piercing member or pike 15) into position when needed. For example the operative end 12 of the tool may be positioned in a secured structure, such as between a door and door jamb and the flat end of the sledge hammer head 54 used to strike the tapping block 17 to seat the pike or adz in place.

The sledge hammer tool attachment 50 can also be used as a quick extension, when the floor is constructed of wood or other penetrable material. As depicted in FIG. 11, the pointed cone end of the sledge hammer attachment 50 may be slammed into the floor, the handle rotated upwards, the jacking member 52 extended and the sledge hammer attachment 50 quickly connected to the forcible entry tool. This will brace the tool against recoil when force arm 30 is fired. The jacking member 52 of the sledge hammer tool attachment 50 works on principles similar to a manual jack and can be quickly and easily extended and seated back in place. The sledge hammer tool attachment 50 is ruggedly constructed to withstand various pushing and prying duties in its extended position.

Figure 17:
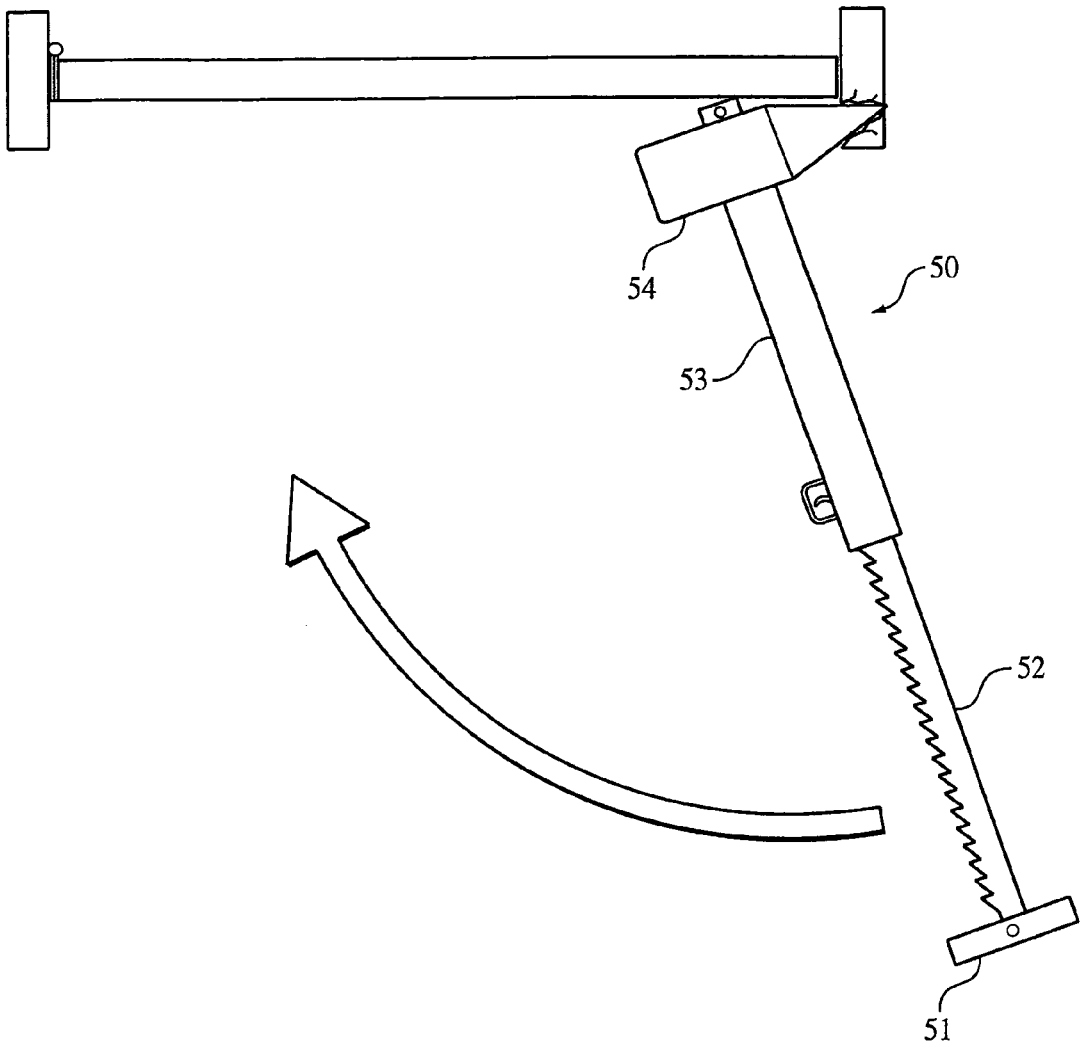
FIG. 17 shows a an overhead view of a sledge hammer attachment according to an embodiment of the invention being used to open an inwardly opening door.

The sledge hammer tool attachment 50 may also serve as a useful manual forcible entry tool alone. For example, sledge hammer tool attachment 50 may be used apart from the forcible entry tool to manually gain access to a secured door as shown in FIG. 17, wherein the pointed tip of the sledge hammer head 54 is slammed into the door frame and the handle is rotated to force the door open. Additionally, the pointed end of sledge hammer attachment tool 50 can be used to put holes in a door for placing cone door plates 80 as shown in FIGS. 10-13 and described in more detail herein Various attachments may also be detachably secured to the impact head 31 of force arm 30. FIG. 9 shows a pointed tip attachment or harpoon residual recoil arrester 70. Pointed tip attachment 70 may have a pointed tip 71 at one end and displaceable barbs 72 disposed around its body portion. A connecting member 73, for example a threaded projection, is disposed opposite pointed tip 71 for detachably securing the pointed tip attachment 70 to the impact head. Barbs 72 may be spring loaded and project outwardly after the pointed tip attachment penetrates a secured structure. Pointed tip attachment 71 may be used, for example to lodge in the jamb of an outwardly opening door to arrest any residual recoil.

FIG. 10 shows a cone door plate attachment 80. Cone door plate attachment has a pointed tip 81 at one end and one or more plates 82 extending outwardly from body of the cone. The cone and/or plated may be constructed from metal. A connecting member 83, for example a threaded projection, is disposed opposite pointed tip 81 for detachably securing the door cone plate attachment 80 to the impact head. The plates 82 on the cone provide a sufficient surface area to prevent the force arm 30 from being driven right through a door and allow the impact of the force arm 30 to blow the door open as intended. Plates 82 may be disposed at various angles with respect to pointed tip 81 depending on the particular application and angle of attack. For example in FIG. 13, where the forcible impact tool is positioned substantially perpendicular to the door to be breached, a cone door plate attachment 80 having plates 82 disposed substantially perpendicular to the tip 81 of the attachment is shown. In FIGS. 11 and 12, where the forcible impact tool is positioned at an angle with respect to the door to be breached, a cone door plate attachment 80 having plates 82 secured at an angle with respect to the tip 81 of the attachment is shown.

Figure 14:
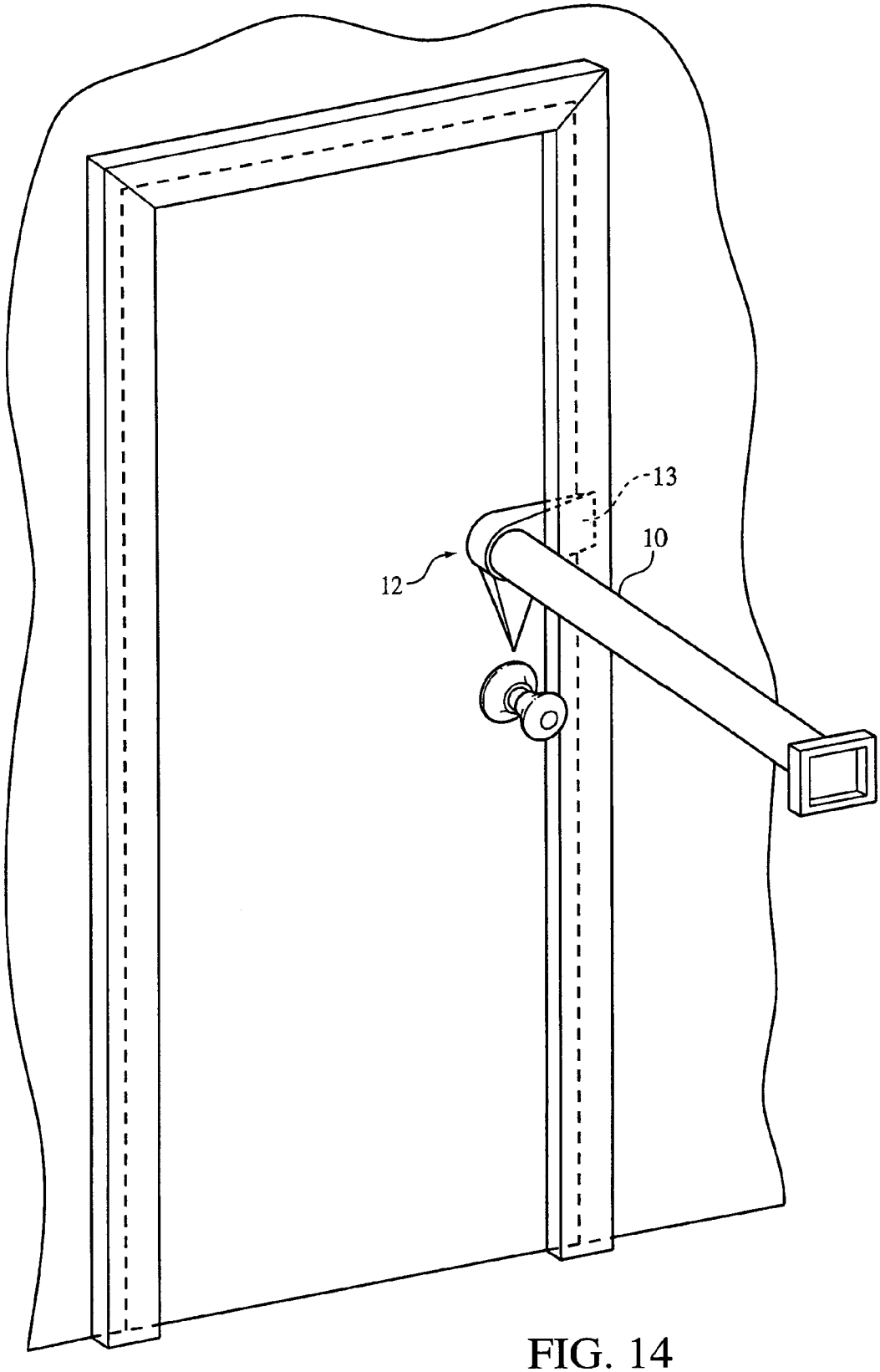
FIG. 14 shows a forcible entry tool according to an embodiment of the invention positioned to open an inwardly opening door having a metal door jamb.

FIG. 14 shows a forcible entry tool according to an embodiment of the invention positioned to open an inwardly opening door having a metal door jamb. As shown, when forcing a jamb, the prying member 13 at operative end 12 of the housing 10 is wedged behind the door stop or jamb. The tool is then triggered, and the force arm is ejected into the door forcing it open in an explosive manner. The recoil is absorbed by the prying member 13 resting against the metal door stop or jamb.

If the space between the door and the jamb is tight, the prying member may be tapped into place using the sledge hammer tool attachment. In the event the force arm does not meet enough resistance form the door, the force arm will release and fly out of the housing to prevent pulling the operator forward. This event should occur very infrequently because the door should be sized up and evaluated using the manual capabilities of the forcible entry tool prior to discharging the force arm.

Figure 15:
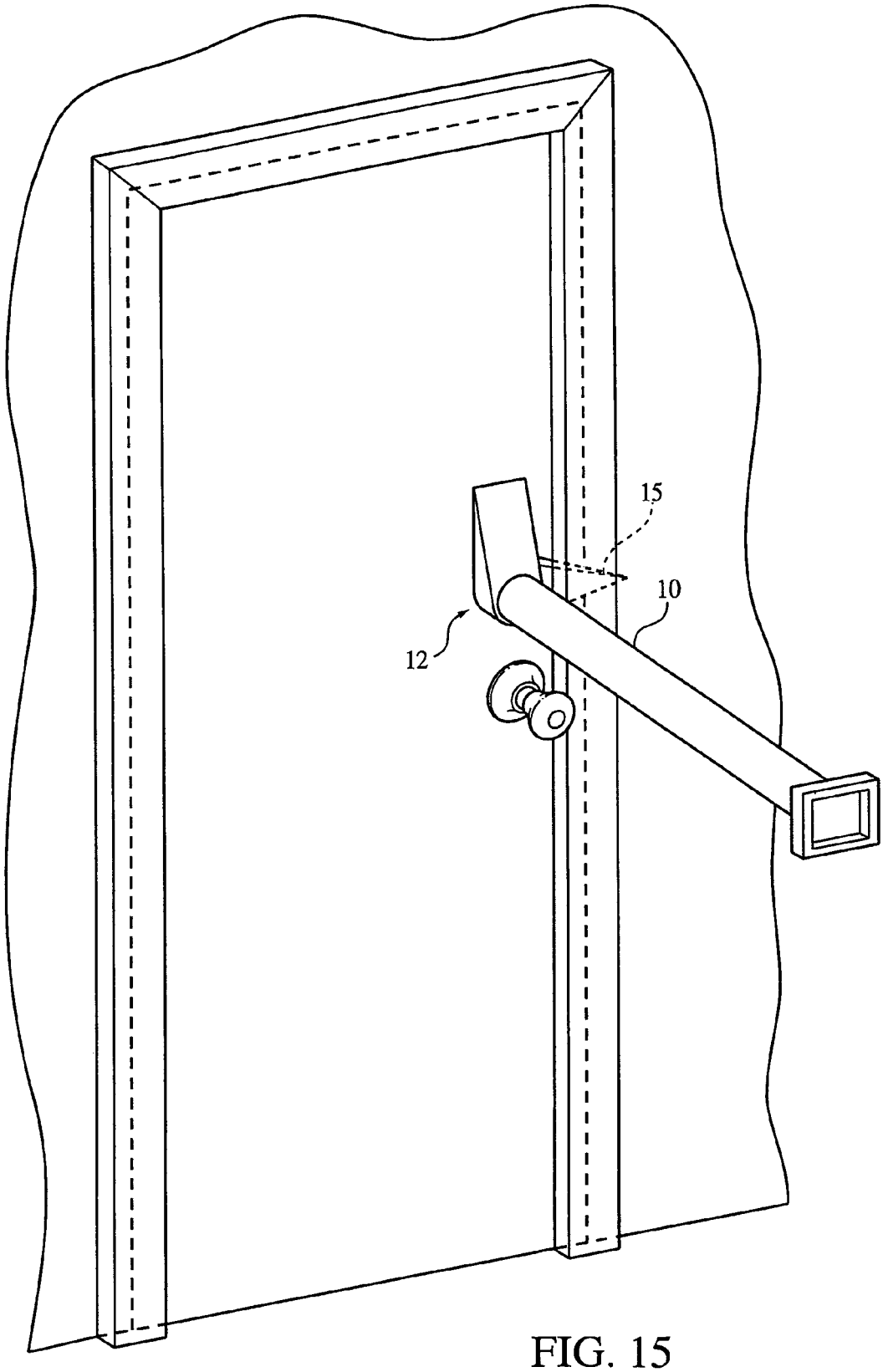
FIG. 15 shows a forcible entry tool according to an embodiment of the invention positioned to open an inwardly opening door having a wooden door jamb.

FIG. 15 shows a forcible entry tool according to an embodiment of the invention positioned to open an inwardly opening door having a wooden door jamb. As shown, the piercing member 15 at operative end 12 of the housing 10 is wedged behind the door stop or jamb. The piercing member 15 may be hammered into place using the sledge hammer tool attachment. The tool is then triggered, and the force arm is ejected into the door forcing it open in an explosive manner. The recoil is absorbed by the piercing member 15 seated in the jamb or stop.

Figure 16:
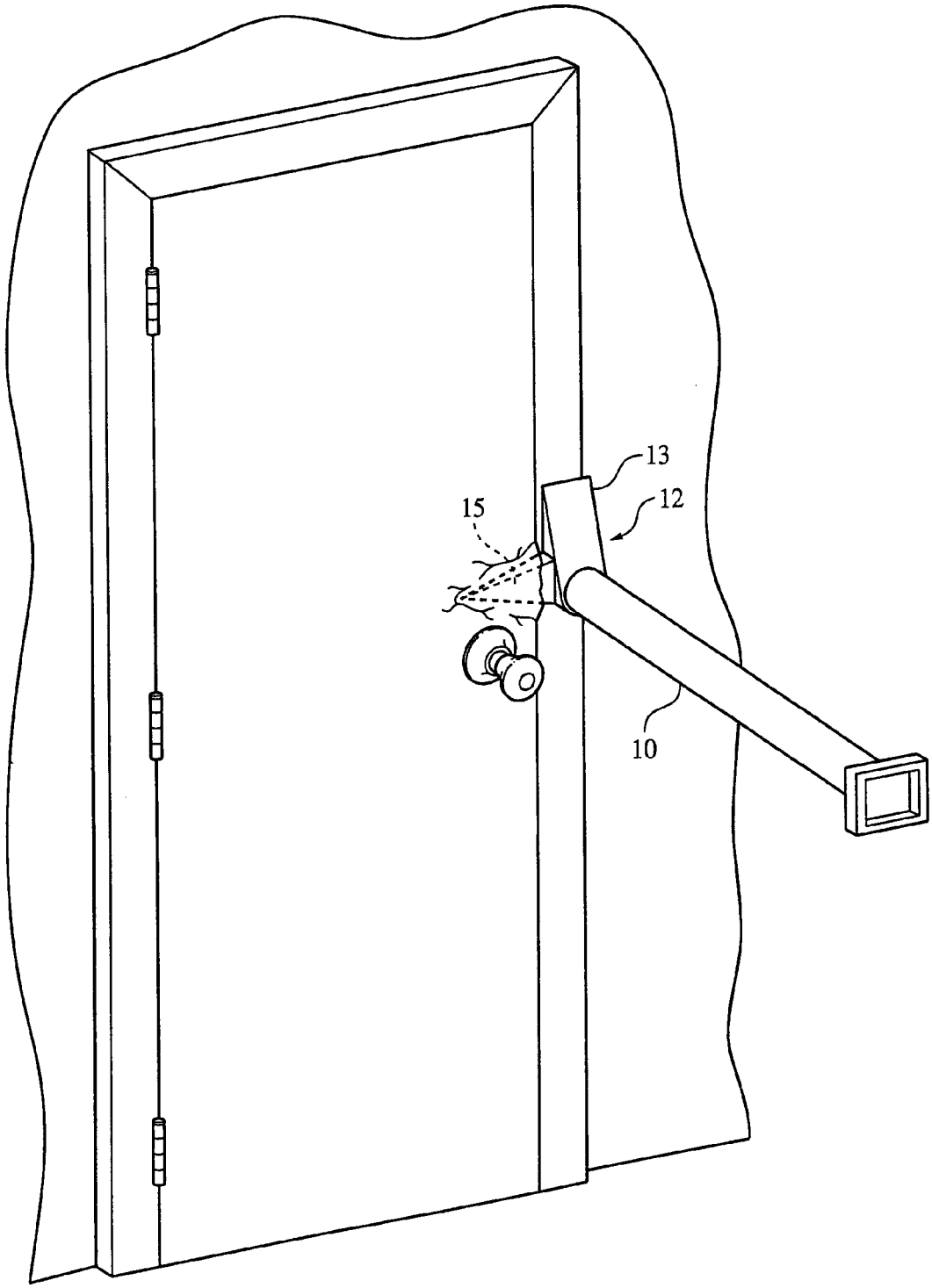
FIG. 16 shows a forcible entry tool according to an embodiment of the invention positioned to open an outwardly opening door.

FIG. 16 shows a forcible entry tool according to an embodiment of the invention positioned to open an outwardly opening door. Here, the prying member 13 or piercing member 15 is slammed into the space between the door and the jamb. The forcible entry tool is rotated so that the impact head of the force arm is resting on the door jamb. The tool is triggered, discharging the force arm and ripping the door open. This method may also be used to rip the hinges off the door by positioning the tool on the hinged side of the door.

Additionally, the prying member 13 or piercing member 15 can be used to exploit an opening under the door by positioning the impact head against the floor and discharging the force arm, thereby blowing the door up and out. As can be appreciated, due to the features of the tool according to an embodiment of the invention, methods of entry using such a tool are numerous.

Accordingly, while a number of embodiments of the present invention have been shown and described, it is obvious that many changes and modifications may be made thereunto without departing from the spirit and scope of the invention.

What is claimed is:

1. A forcible entry tool for gaining access to a secured structure, the forcible entry tool comprising:

a) a hollow elongated cylindrical housing defining an interior chamber therein, said hollow elongated cylindrical housing comprising an operative end adapted to manually seat said housing, said operative end comprising:

i) a wedge projecting outward at an angle from said housing, said wedge having substantially flat upper and lower surfaces terminating in an edge distal said housing; and ii) a piercing member projecting outward at an angle from said housing, said piercing member terminating in a sharp point distal said housing;

b) a force arm disposed substantially within said interior chamber, said force arm comprising an impact head adapted to impact the secured structure; and c) a force arm drive for displacing said force arm at a high velocity to impact the secured structure.

2. The forcible entry tool according to claim 1 wherein said wedge comprises a prying member.

3. The forcible entry tool according to claim 1 wherein said piercing member comprising an elongated, curved member.

4. The forcible entry tool according to claim 1, wherein said housing further comprises a tapping block for driving said operative end into position.

5. The forcible entry tool according to claim 1, wherein said force arm drive comprises a blank munition charge.

6. The forcible entry tool according to claim 5, further comprising a reverse trigger mechanism for actuating said blank munition charge.

7. The forcible entry tool according to claim 1, wherein said force arm drive comprises a fuel cell charge.

8. The forcible entry tool according to claim 1, further comprising a sledge hammer tool disposed at an end of the forcible entry tool opposite said operative end.

9. The forcible entry tool according to claim 8, wherein said sledge hammer tool comprises a pointed substantially conical head for penetrating a surface.

10. The forcible entry tool according to claim 8, wherein said sledge hammer tool is detachably secured to the forcible entry tool.

11. The forcible entry tool according to claim 8, further comprising a jacking mechanism for displacing said sledge hammer tool relative to the forcible entry tool.

12. The forcible entry too according to claim 1, further comprising a base plate disposed at an end of the forcible entry tool opposite said operative end.

13. The forcible entry tool according to claim 12 wherein said base plate is detachably secured to the forcible entry tool.

14. The forcible entry tool according to claim 12 further comprising a jacking mechanism for displacing said base plate relative to the forcible entry tool.

15. The forcible entry tool according to claim 1, wherein said impact head of said force arm is adapted for receiving an attachment.

16. The forcible entry tool according to claim 15 wherein said attachment comprises a pointed tip having a plurality of displaceable barbs disposed thereon.

17. The forcible entry tool according to claim 15 wherein said attachment comprises a cone door plate.

18. The forcible entry tool according to claim 1, further comprising a ball spring stop for allowing said force arm to be released from said housing after being fired from said housing if said force arm is not met with a sufficient degree of resistance.

19. A forcible entry tool for gaining access to a secured structure, the forcible entry tool comprising:

a) a hollow elongated housing defining an interior chamber therein, said hollow elongated housing comprising an operative end adapted to manually seat the forcible entry tool;

b) a force arm disposed substantially within said interior chamber, said force arm comprising an impact head adapted to impact the secured structure and a serrated portion for engaging a corresponding lockout mechanism disposed in said interior chamber to resist a rearward movement of said force arm once extended; and c) a force arm drive for displacing said force arm at a high velocity to impact the secured structure.

* * * * *